US010704562B2

(12) United States Patent
Cool

(10) Patent No.: US 10,704,562 B2
(45) Date of Patent: Jul. 7, 2020

(54) CENTRIFUGAL FAN AND HEATING DEVICE PROVIDED THEREWITH

(71) Applicant: Intergas Heating Assets B.V., Coevorden (NL)

(72) Inventor: Peter Jan Cool, Lochem (NL)

(73) Assignee: INTERGAS HEATING ASSETS B.V., Coevorden (NL)

( * ) Notice: Subject to any disclaimer, the term of this patent is extended or adjusted under 35 U.S.C. 154(b) by 166 days.

(21) Appl. No.: 15/740,104

(22) PCT Filed: Jul. 22, 2016

(86) PCT No.: PCT/NL2016/050551
§ 371 (c)(1),
(2) Date: Dec. 27, 2017

(87) PCT Pub. No.: WO2017/018881
PCT Pub. Date: Feb. 2, 2017

(65) Prior Publication Data

US 2018/0187695 A1 Jul. 5, 2018

(30) Foreign Application Priority Data

Jul. 24, 2015 (NL) ..... 2015220

(51) Int. Cl.
*F04D 29/66* (2006.01)
*F04D 29/42* (2006.01)
(Continued)

(52) U.S. Cl.
CPC ..... *F04D 29/4253* (2013.01); *F04D 29/422* (2013.01); *F04D 29/4213* (2013.01);
(Continued)

(58) Field of Classification Search
CPC ..... F04D 29/4253; F04D 29/4213; F04D 29/422; F04D 29/4226; F04D 29/667;
(Continued)

(56) References Cited

U.S. PATENT DOCUMENTS 2,635,548 A * 4/1953 Brawley ..... F04D 7/04 406/99
3,628,881 A * 12/1971 Herrmann, Jr. ..... F04D 29/2216 415/119
(Continued)

FOREIGN PATENT DOCUMENTS

EP 3076023 A1 * 10/2016 ..... F04D 17/16
FR 2746864 A1 10/1997
(Continued)

OTHER PUBLICATIONS

PCT International Search Report and Written Opinion; PCT/NL2016/050551, dated Nov. 7, 2016.
(Continued)

*Primary Examiner* — Moshe Wilensky
*Assistant Examiner* — Brian Christopher Delrue

(57) ABSTRACT

The present invention relates to a centrifugal fan comprising a fan housing with a radial outlet opening arranged in a radial peripheral wall thereof, a rotor arranged rotatably in the fan housing and provided close to an axial rotation axis thereof with a rotor inflow opening, wherein the fan housing is provided close to the rotation axis of the rotor with an axial inlet opening, and a tube part which extends in the fan housing from the radial outlet opening arranged in the radial peripheral wall and inward along the radial peripheral wall. The invention further relates to a heating device comprising a burner with a fuel mixture infeed opening, a centrifugal fan according to the invention, and wherein a fluid connection is
(Continued)

provided between the fuel mixture infeed opening of the burner and the outlet opening of the centrifugal fan.

19 Claims, 6 Drawing Sheets

(51) Int. Cl.
*F23D 14/36* (2006.01)
*F23L 5/02* (2006.01)

(52) U.S. Cl.
CPC ..... *F04D 29/4226* (2013.01); *F04D 29/667* (2013.01); *F04D 29/669* (2013.01); *F05D 2250/50* (2013.01); *F05D 2250/52* (2013.01); *F23D 14/36* (2013.01); *F23L 5/02* (2013.01)

(58) Field of Classification Search
CPC ..... F04D 29/669; F05D 2250/50; F05D 2250/52; F23D 14/36; F23L 5/02
See application file for complete search history.

(56) References Cited

U.S. PATENT DOCUMENTS 4,156,344 A * 5/1979 Cuthbertson ..... F02C 7/045 415/119
4,212,585 A * 7/1980 Swarden ..... F04D 27/0215 415/198.1
5,127,800 A * 7/1992 Hyll ..... F04D 29/4286 415/197
5,286,162 A * 2/1994 Veres ..... F04D 29/422 415/115
5,292,244 A * 3/1994 Xiong ..... B01F 5/0451 239/414
5,842,840 A * 12/1998 Korek ..... F04D 29/441 417/423.14
6,158,083 A * 12/2000 Holsten ..... A47L 5/365 15/326
8,480,359 B2 * 7/2013 Pan ..... F04D 29/4213 415/204
2005/0265832 A1 * 12/2005 Horng ..... F04D 25/166 415/206
2006/0051716 A1 * 3/2006 Roelfsema ..... F23D 14/085 431/125
2006/0062669 A1 * 3/2006 Nishikawa ..... F04D 29/281 415/206
2007/0104573 A1 * 5/2007 Sun ..... F04D 25/08 415/206
2008/0292455 A1 * 11/2008 Glore ..... F04D 25/084 415/204
2011/0008153 A1 * 1/2011 Kato ..... F04D 13/06 415/143
2013/0092104 A1 * 4/2013 Cool ..... F23D 14/36 122/17.1

FOREIGN PATENT DOCUMENTS

WO WO-9964747 A1 * 12/1999 ..... A61M 16/0057
WO WO199964747 A1 12/1999
WO WO-2009124339 A1 * 10/2009 ..... F04D 29/422
WO WO2009124339 A1 10/2009
WO WO2011074957 A1 6/2011
WO WO-2015048231 A1 * 4/2015 ..... F02B 37/24
WO WO2015048231 A1 4/2015

OTHER PUBLICATIONS

International Preliminary Report on Patentability (IPRP) , PCT/NL2016/050551, dated Oct. 19, 2017.

* cited by examiner

CENTRIFUGAL FAN AND HEATING DEVICE PROVIDED THEREWITH

This is a national stage application filed under 35 U.S.C. 371 of pending international application PCT/NL2016/050551, filed Jul. 22, 2016, which claims priority to Netherlands patent application NL 2015220, filed Jul. 24, 2015, the entirety of which applications are incorporated by reference herein.

The present invention relates to a centrifugal fan comprising a fan housing with a radial outlet opening arranged in a radial peripheral wall thereof, a rotor arranged rotatably in the fan housing, wherein the fan housing is provided with an inlet opening. The invention relates more particularly to a centrifugal fan for a heating device.

The invention further relates to a heating device comprising a burner with a fuel mixture infeed opening, a centrifugal fan, and wherein a fluid connection is provided between the fuel mixture infeed opening of the burner and the outlet opening of the centrifugal fan.

A frequently occurring phenomenon in heating devices such as gas boilers is the occurrence of noise generation which is determined to a considerable extent by a thermoacoustic behaviour. The thermoacoustic sound is usually manifested as an undesirable humming sound and can cause annoyance to users and moreover—unjustly—reduce the perception of the quality of the gas boiler. The combustion quality can further be very adversely affected (more CO formation). In addition to the burner itself, elements upstream, and to lesser extent downstream, of the burner also influence the thermoacoustic sound production.

Efforts to reduce the thermoacoustic sound are generally based on arranging a tube part with a plurality of bends upstream of the burner. Such tube parts are constructed experimentally and can take complex forms, whereby they are often voluminous. Because of their complex nature development and manufacture thereof are in addition relatively time-consuming, and this curved tube increases the flow resistance through the heating device. Additional Helmholtz resonators are sometimes also applied which further contribute toward the complexity and development time and costs.

A voluminous centrifugal fan of the above stated type is known from US-2008/292455 wherein in assembled state a deep pan and a cover form the fan housing. The pan is considerably deeper than a thickness of the rotor, and swirling flows therein contribute toward the generated sound.

An object of the present invention is to provide a heating device wherein the stated drawbacks do not occur, or at least do so to lesser extent.

Said object is achieved according to the invention with a centrifugal fan comprising all features of the independent appended claim relating to the centrifugal fan.

It is noted that US-2008/292455 discloses a transition between the wall of the pan and an exit opening for outflow of an airflow. Both the housing and the outflow opening and this transition are only closed when the cover is mounted on the pan. Swirling occurs here in the pan in height direction relative to the rotor, and sound is generated as a result. In this configuration there is therefore not a tube part protruding through the wall of the fan housing; there is only a conventional spiral-shaped fan housing with only a tangential outflow tube without a part that protrudes as tube into the housing. According to the invention however, the tube part extends radially relative to the rotor along and adjacently of the rotor so as to define a substantially tangentially oriented passage from the outlet opening to a coupling part.

Protruding of the tube part into the interior of the fan housing causes a disruption of a smooth inner wall of the fan housing, and the skilled person would expect this to bring about loss of efficiency in the centrifugal fan, on the basis of which this skilled person would not consider such a modification as proposed in the present disclosure and continue to research elaborate and costly tube configurations outside the fan housing for the purpose of sound reduction. The measure taken of the tube part protruding into the fan housing is however notable for its simplicity and effectiveness in respect of sound reduction at the cost of an astonishingly low loss of efficiency of only a maximum of a few percent.

Compared to the experimentally developed complex prior art tube parts provided with bends, the tube part according to the invention has many advantages. The tube part is much shorter, whereby less material is required. In addition, the tube part is less complex, thereby shortening the development time for achieving a desired sound reduction. The tube part is moreover integrated into an existing component, i.e. the spiral casing of the centrifugal fan, whereby a compact and robust solution is provided.

When the rotor rotates in the fan housing, the rotor exerts a centrifugal force on the fluid which is present close to the rotor inflow opening and which thereby moves outward in radial direction. Because the fluid flows away from the rotor inflow opening, an underpressure is created there which ensures that the centrifugal fan draws in fresh fluid via the axial inlet opening of the fan housing, generally via a suction conduit.

The fluid moved outward by the rotor is compressed to some extent and, due to the overpressure and the velocity imparted by the rotor, will flow away via the outlet opening out of the fan housing, for instance via a pressure conduit connected to the outlet opening.

The centrifugal fan in this way provides for a continuous flow of fluid via the inlet opening to the outlet opening.

Because the centrifugal fan according to the invention is provided with a tube part which extends in the fan housing from the radial outlet opening arranged in the radial peripheral wall and inward along the radial peripheral wall, the outlet opening is in fact displaced inward from the radial peripheral wall of the fan housing into the fan housing, this resulting in a change in flow behaviour/swirling at the outlet opening of the centrifugal fan. The thermoacoustic behaviour—in particular at the so-called cut-off—is hereby suppressed. The cut-off is the area in the spiral casing where the distance between the wall of the spiral casing and the rotor placed asymmetrically in the spiral casing is minimal and where the outlet opening is arranged. From the cut-off a buildup in pressure takes place in the rotation direction of the rotor up to the outlet opening, and the distance between the rotor and the inner wall of the spiral casing gradually increases.

One of the elements affecting the thermoacoustic behaviour is the centrifugal fan which forces the fuel/air mixture through the burner. The centrifugal fan according to the invention reduces the production of thermoacoustic sound, whereby a heating device can be silent while a complex prior art tube provided with bends and requiring space is redundant.

With advantages in use of space the centrifugal fan according to the present disclosure is such that the fan housing comprises a pan-like part, in which the rotor is arranged, and a cover mounted releasably on the pan-like part. With advantages in convenience of assembly and leak-tightness the centrifugal fan according to the present disclosure is further such that the tube part extends in the fan housing from the radial outlet opening arranged in the radial peripheral wall and inward along the radial peripheral wall at a distance relative to the cover. With further advantage in the same or similar aspects and functionalities, the centrifugal fan is still further such in the latter embodiment that the tube part defines, of itself and without being closed by means of the cover, in the pan-like part of the fan housing a discharge passage closed all around and having an entrance (50) thereof at a distance from the radial outlet opening (30). This has been found to be particularly advantageous in respect of sound reduction.

In an embodiment with a pan-like part and a cover the centrifugal fan according to the present disclosure is such that a depth of the pan-like part of the fan housing substantially corresponds to a thickness of the rotor in the axial direction thereof, and the tube part extends radially relative to the rotor along and adjacently of the rotor. The centrifugal fan can further be such here that the tube part has a dimension in axial direction of the rotor, which dimension is at most as great as the thickness of the rotor in the same orientation. A compact configuration can thus be realized which, by means of the optionally also realized lengthening of the discharge passage relative to the single radial outlet opening (30), can bring about a drastic reduction in noise.

The tube part (42) can further comprise a curvature (44) corresponding to and at some distance from a periphery of the rotor.

When according to a preferred embodiment the tube part extending in the fan housing comprises a tapering part which tapers in the direction of an entrance to a discharge passage defined by the tube part, which entrance is located at a distance from the radial outlet opening, space is created for the rotor. The greater the radial dimension of the rotor, the more capacity it has. Because the tapering tube part is provided with a smaller opening than the standard outlet opening of a conventional centrifugal fan, it was anticipated during development that the tapering tube part would cause an undesirable increase in the flow resistance. Surprisingly, this effect is found to be minimal, which is explained by the fact that the tapering ensures that a widening occurs downstream of the open end of the tube part situated in the fan housing. This widening results in a decrease of the pressure inside the tube part. Similarly to the action of a venturi, this pressure drop has a suctioning effect on the fluid entering the tube part through the open end of the tube part situated in the fan housing.

A maximal flow rate through the tube part is achieved when according to a further preferred embodiment the tapering part of the tube part comprises a curved contour which substantially corresponds to the outer periphery of the rotor. In addition, a pressure buildup can take place in the distance between the rotor and the wall of the curved contour, this being further elucidated below.

Optimal operation is obtained when according to a further preferred embodiment the distance between the outer periphery of the rotor and the wall of the tube part facing toward the rotor lies in the range of 1-10 mm. If the distance is smaller, an undesirable whistling sound can occur. If the distance is too great, it has been found in experiments that the sound reduction decreases. A possible explanation is that, if the distance is too great, insufficient benefit is derived from a pressure buildup. Another possible explanation is that due to the change in the exit point (where the fuel/air mixture leaves the rotor) there is a different or lesser swirling, similarly to the action of turbulence-suppressing tip vanes on outer ends of aircraft wings.

According to a further preferred embodiment, the tube part extending in the fan housing comprises a further tube part of substantially constant cross-section between the radial peripheral wall and the tapering part.

According to yet another preferred embodiment, the tube part extending in the fan housing comprises between the radial peripheral wall and the open end of the tube part at least one passage arranged in the peripheral wall of the tube part. Fluid which flows from the fan housing through this extra passage into the tube part affects the main flow through the tube part and thus brings about a change in flow behaviour which has been found favourable in the suppression of thermoacoustic sound generation.

It has been found that the shaping of the beginning of the tube part through which the gas/air mixture leaves the housing of the centrifugal fan has a strong influence on the thermoacoustic behaviour.

It is noted that the optimal location, size and shape of the passage arranged in the peripheral wall of the tube part still has to be determined experimentally, although in many tests the preferences which are described in this application and which are the subject matter of the following preferred embodiments have been found to be particularly advantageous.

According to yet another preferred embodiment, the passage arranged in the peripheral wall of the tube part is arranged in the area between halfway along the tapering part and the radial peripheral wall.

According to yet another preferred embodiment, the passage arranged in the peripheral wall of the tube part is arranged in the further tube part of substantially constant cross-section which is further downstream of the open end of the tube part situated inside the fan housing.

According to yet another preferred embodiment, the passage arranged in the peripheral wall of the tube part is arranged in the area between halfway along the further tube part of substantially constant cross-section and the transition between the tapering part and the further tube part of substantially constant cross-section. This area has been found in experiments to be particularly effective.

Optimum benefit is derived from a pressure buildup between the rotor and the wall of the tube part when substantially the whole tapering part of the tube part is utilized to develop this pressure buildup. According to yet another preferred embodiment, the passage arranged in the peripheral wall of the tube part is therefore arranged substantially adjacently of the transition between the tapering part and the further tube part of substantially constant cross-section.

According to a further preferred embodiment and a further aspect of the invention, the axial inlet opening of the fan housing is provided with a suction conduit for drawing in a fuel/air mixture, wherein the suction conduit extends in radial direction along the fan housing so that an indrawn fuel/air mixture is deflected close to the inlet opening from a radial flow direction to an axial flow direction. It has been found that this substantially right-angled deflection of the fuel/air mixture has a favourable effect on the thermoacoustic behaviour, wherein this measure contributes toward the sound reduction obtained by the tube part extending in the fan housing from the radial outlet opening arranged in the radial peripheral wall and inward along the radial peripheral wall.

According to yet another preferred embodiment, the suction conduit comprises a mixing part which is in fluid connection with a fuel feed conduit and which is further in fluid connection with an air supply. In the mixing part fuel and air are mixed to form a fuel/air mixture which is guided further from the mixing part through the suction conduit to the axial inlet opening of the fan housing.

According to yet another preferred embodiment, the fuel feed conduit is an inner conduit arranged inside the fluid connection to the air supply.

According to yet another preferred embodiment, the fluid connection to the air supply comprises an open connection to the environment, whereby air is obtained from an inexhaustible natural supply. A closed container with a limited air supply which would require periodic refilling is hereby unnecessary.

According to yet another preferred embodiment, the mixing part is provided with a venturi. When the rotor of the centrifugal fan is driven and brings about an underpressure in the suction conduit, fuel and air are drawn in through the suction conduit. An additional suctioning effect is obtained by providing a venturi in the mixing part. Just as the suction conduit in which it is arranged, the venturi is oriented in radial direction.

The invention further relates to a heating device, comprising:

a burner with a fuel mixture infeed opening;

a centrifugal fan according to the invention; and wherein a fluid connection is provided between the fuel mixture infeed opening of the burner and the outlet opening of the centrifugal fan.

Preferred embodiments of the present invention are further elucidated in the following description with reference to the drawing, in which:

FIG. 3B shows an exploded view;

Figure 1:
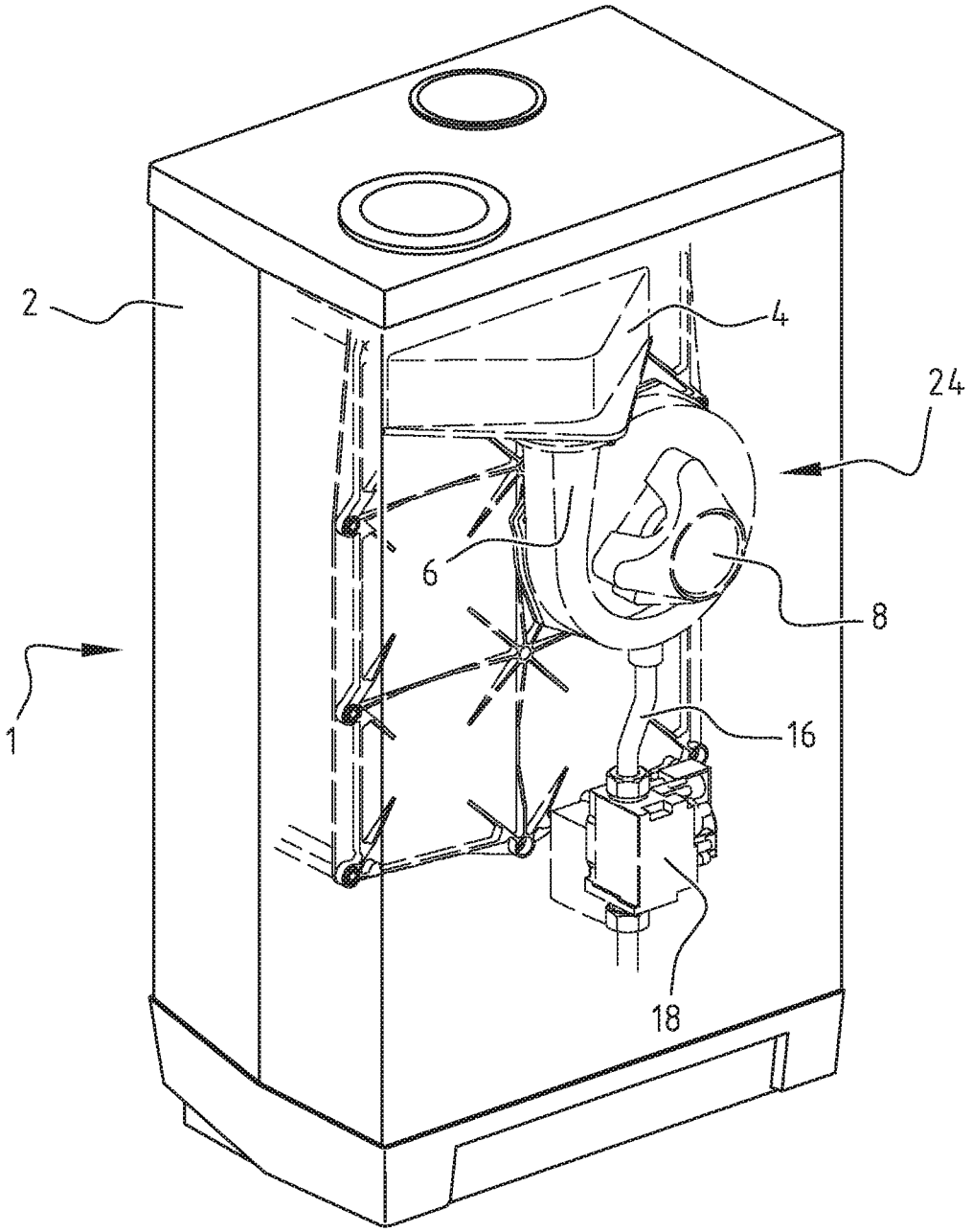
FIG. 1 is a cut-away perspective view of a heating device comprising a centrifugal fan according to the invention.

Heating device 1 in FIG. 1 comprises a housing 2 in which a burner 4 is arranged. Burner 4 is provided via a pressure conduit 6 with a fuel/air mixture which is drawn in by a centrifugal fan 24 via a suction conduit 10. Provided in suction conduit 10 is a mixing chamber 12 in which air drawn in by a fluid connection 14 is mixed with fuel drawn in by a fuel feed conduit 16 from a gas block 18. Centrifugal fan 24 is driven by a motor 8.

Figure 2A:
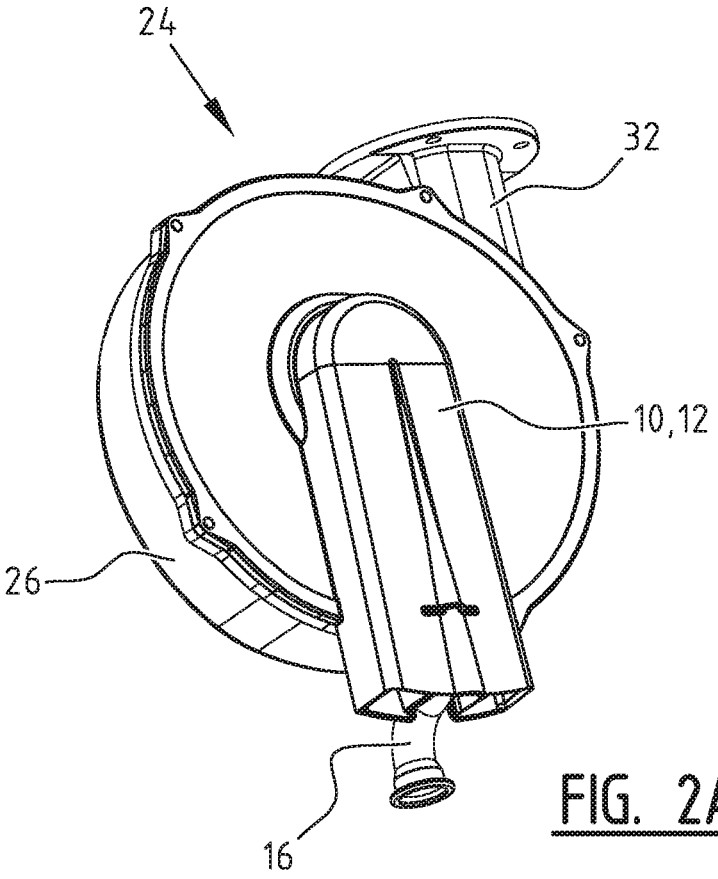
FIGS. 2A and 2B are perspective views of the centrifugal fan of FIG. 1.
Figure 2B:
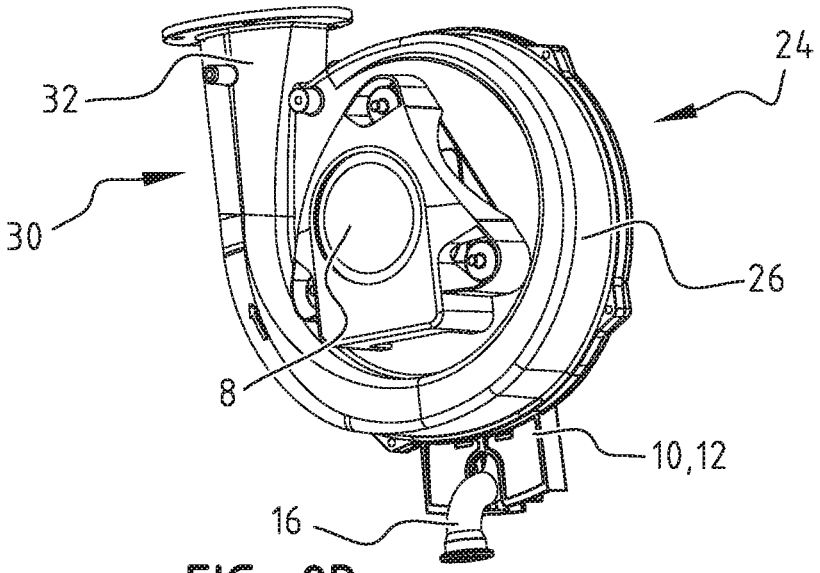

Centrifugal fan 24 comprises a fan housing 26 closable with a cover and having a radial outlet opening 30 arranged in a radial peripheral wall 28 thereof. In the shown embodiment the radial outlet opening 30 runs in an approximately tangential direction to a coupling part 32 to which pressure conduit 6 is connectable (FIGS. 2A and 2B).

A rotor 34 is arranged rotatably in fan housing 26. Rotor 34 is provided close to an axial rotation axis 36 thereof with a rotor inflow opening 38. Fan housing 26 is provided close to rotation axis 36 of rotor 34 with an axial inlet opening 40.

When rotor 34 is driven rotatably in fan housing 26 by motor 8, the revolving rotor 34 exerts a centrifugal force on the fluid present close to rotor inflow opening 38. This fluid is hereby moved in radial direction outward in the direction of radial peripheral wall 28 of fan housing 26. Because the fluid flows away from rotor inflow opening 38, an underpressure is created there which ensures that centrifugal fan 24 draws in fresh fluid via axial inlet opening 40 of fan housing 26. A suction conduit 10 extending radially along fan housing 26 is connected to axial inlet opening 40. The substantially right-angled deflection of the fuel/air mixture at the transition from suction conduit 10 to axial inlet opening 40 of fan housing 26 has a favourable effect on the thermoacoustic behaviour, wherein this measure contributes toward the sound reduction obtained by a tube part 42 to be further elucidated below and extending in fan housing 26 from radial outlet opening 30 arranged in radial peripheral wall 28 and inward along radial peripheral wall 28.

The fluid moved radially outward by rotor 34 is compressed to some extent and, due to the overpressure and the velocity imparted by rotor 34, will flow away via radial outlet opening 30 out of fan housing 26 in the direction of burner 4 of heating device 1, such as via the pressure conduit 6 shown in FIG. 1 which is connectable to coupling part 32. Centrifugal fan 24 in this way provides for a continuous flow of fluid via axial inlet opening 40 to radial outlet opening 30.

Figure 3A:
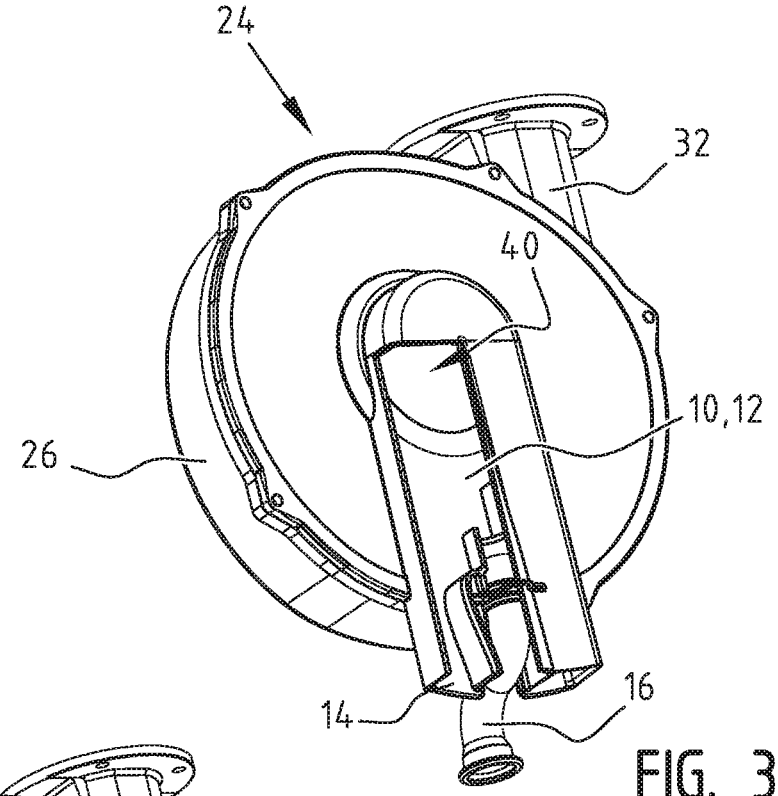
FIGS. 3A and 3B are perspective views according to FIG. 2A, wherein the suction conduit is cut away
Figure 3B:
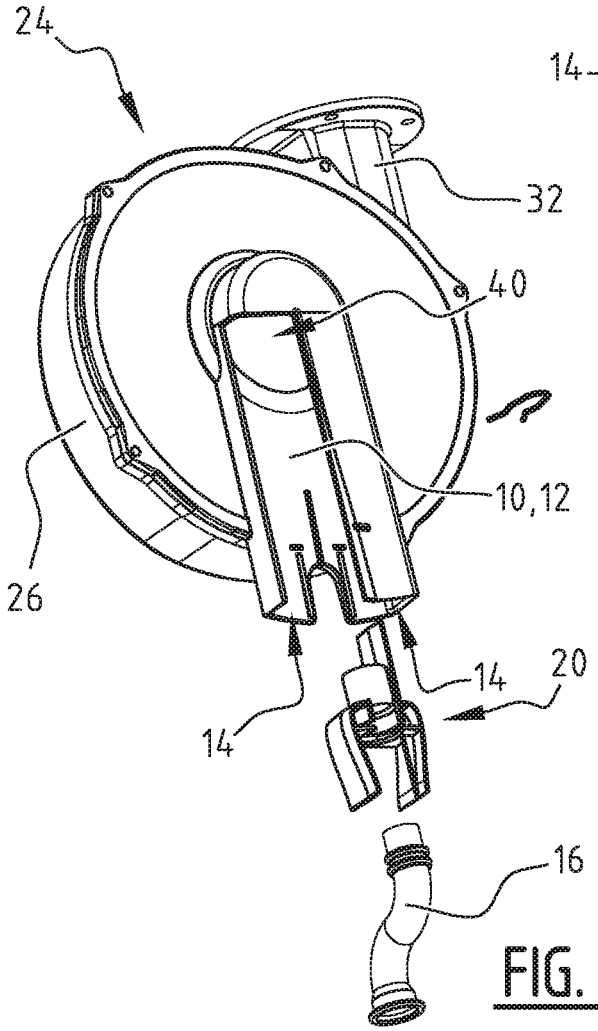

As shown in FIGS. 3A and 3B, suction conduit 10 comprises a mixing part 12 which is in fluid connection with fuel feed conduit 16 and further has a fluid connection 14 to an air supply. Fuel and air are mixed in mixing part 12 to form a fuel/air mixture which is guided further from mixing part 12 through suction conduit 10 to axial inlet opening 40 of fan housing 26.

In the shown embodiment fuel feed conduit 16 is an inner conduit which is arranged inside the fluid connection 14 to the air supply. Fluid connection 14 with the air supply is here an open connection to the environment.

Mixing part 12 is provided with a venturi 20 which provides an additional suctioning effect. Just as suction conduit 10 in which it is arranged, venturi 20 is oriented in radial direction, i.e. substantially transversely of the flow through axial inlet opening 40 (see among others FIGS. 4 and 5).

Figure 6:
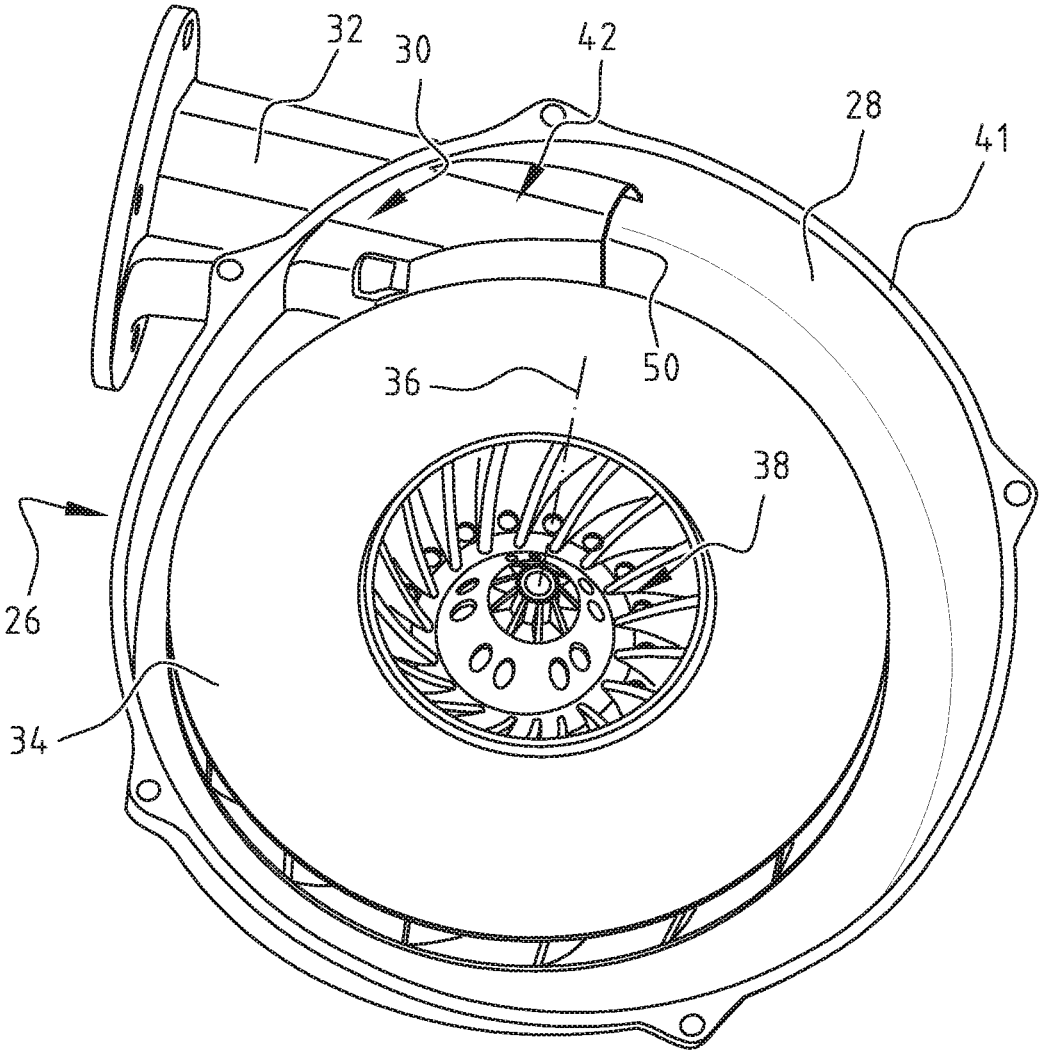
FIG. 6 is a perspective view of the fan housing with a rotor arranged therein and tube part according to the invention provided therein.
Figure 7:
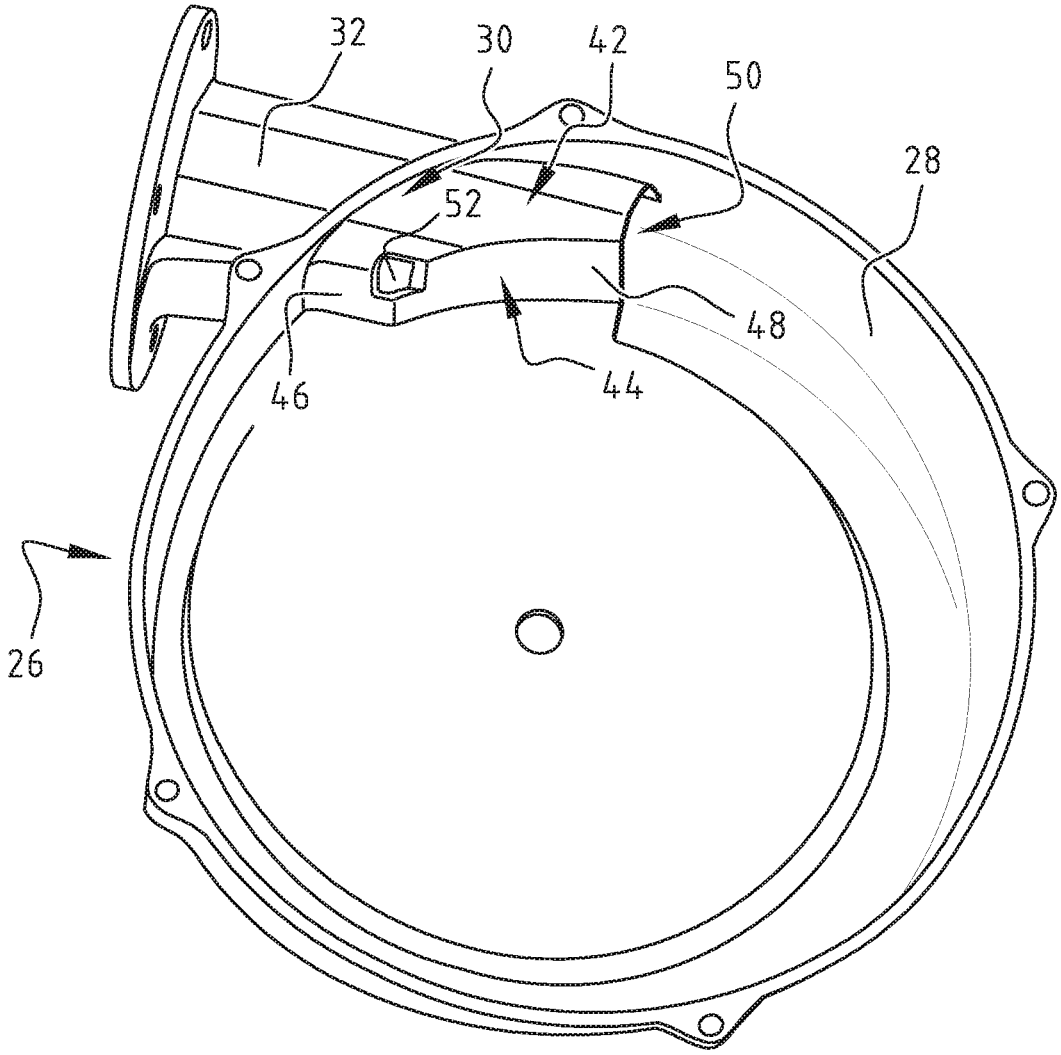
FIG. 7 is a perspective view according to FIG. 6 wherein the rotor is omitted.

Centrifugal fan 24 has a tube part 42 which extends in fan housing 26 from radial outlet opening 30 arranged in radial peripheral wall 28 and inward along radial peripheral wall 28 (FIGS. 6 and 7). The outlet opening is in fact hereby displaced inward from radial peripheral wall 28 of fan housing 26 into fan housing 26.

In the shown embodiment tube part 42 has, extending inward from radial peripheral wall 28 of the fan housing, first a part 46 of a substantially constant cross-section which transposes into a tapering part 44. Fuel/air mixture leaving fan housing 26 follows the reverse path and enters tube part 42 via the open outer end 50. Tapering part 44 then widens in downstream direction, whereby a pressure drop occurs in the main flow through tube part 42 flowing through opening 50 before the main flow reaches the part 46 of substantially constant cross-section.

Close to the transition between tapering part 44 and the part 46 of substantially constant cross-section a passage 52 is arranged in the wall of tube part 42. Because of this passage 52 an additional flow of fuel/air mixture moved radially outward by rotor 34 will occur in tube part 42 which enters into an interaction with the main flow already flowing there. It has been found experimentally that this is favourable in preventing thermoacoustic sound effects. As a result of the interaction which occurs a favourable thermoacoustic effect results which substantially wholly suppresses the undesired humming sound.

It is advantageous for passage 52 to be arranged close to the transition between tapering part 44 and the part 46 of substantially constant cross-section because the fuel/air mixture has the opportunity between rotor 34 and wall 48 of tapering part 44 to build up pressure.

In order on the one hand to enhance this pressure buildup of fuel/air mixture upstream of passage 52 and on the other enable a maximum flow rate of the main flow through tube part 42 the tapering part 44 is embodied with a curvature corresponding to the outer periphery of rotor 34.

Figure 4:
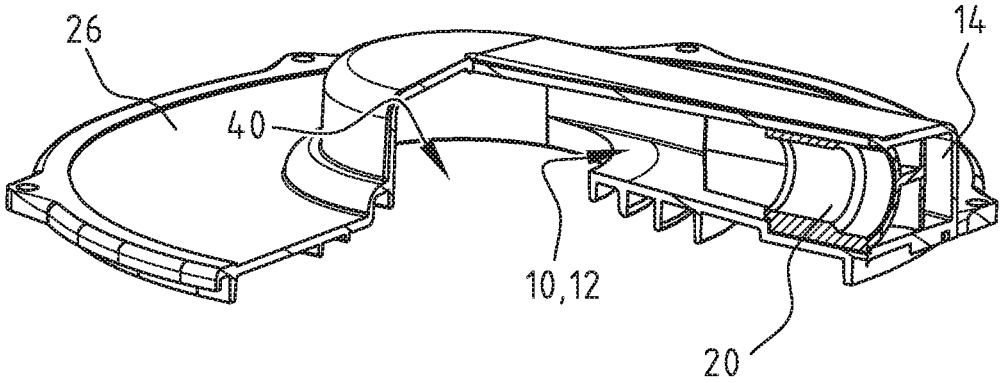
FIG. 4 is a perspective and partially cut-away view of the suction conduit of the centrifugal fan.
Figure 5:
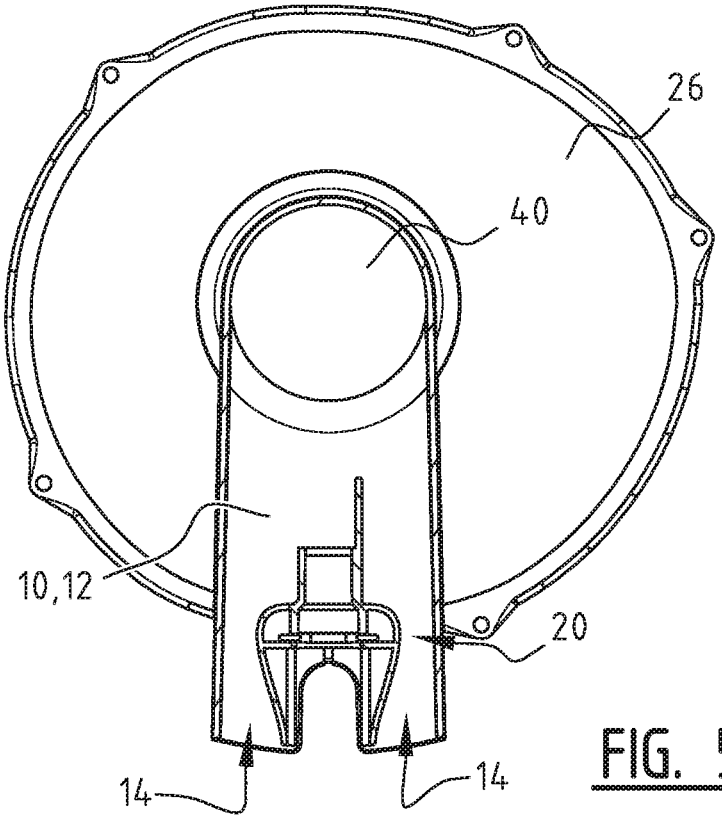
FIG. 5 is a schematic view of the suction conduit of the centrifugal fan.

Fan housing 26 comprises a pan-like part 41 in which rotor 34 is arranged, and a cover as in FIGS. 4 and 5 mounted releasably on the pan-like part. Tube part 42 extends in fan housing 26 in tangential direction from radial outlet opening 30 arranged in radial peripheral wall 28 and inward along radial peripheral wall 28 at a distance relative to the cover. Tube part 42 closes all around, even without the cover on pan-like part 41. The centrifugal fan is such here that tube part 42 defines, of itself and without being closed by means of the cover of FIGS. 4 and 5, in pan-like part 41 of fan housing 26 a discharge passage closed all around and having an entrance 50 as in FIG. 6 at a distance from radial outlet opening 30.

In this embodiment with a pan-like part 41 and a cover as in FIGS. 4 and 5 the centrifugal fan according to the present disclosure is such that a depth of pan-like part 41 of fan housing 26 substantially corresponds to a thickness of rotor 34 in the axial direction thereof. Tube part 42 extends radially relative to rotor 34 along and adjacently of rotor 34 so as to define a substantially tangentially oriented passage. The centrifugal fan is further such here that tube part 42 has a dimension in axial direction of rotor 34 which is at most as great as the thickness of rotor 34 in the same orientation. The tube part is centered here at a height or thickness of rotor 34 whereby swirling airflows are minimized in height or thickness direction of the rotor. A compact configuration can thus be realized which, by means of the optionally also realized lengthening of the discharge passage to open outer end 50, brings about a drastic reduction in noise when compared to the single radial outlet opening 30.

Tube part 42 further comprises a curvature 44 corresponding to and at some distance from a periphery of rotor 34.

Although it shows a preferred embodiment of the invention, the above described embodiment is intended only to illustrate the present invention and not in any way to limit the specification of the invention. When measures in the claims are followed by reference numerals, such reference numerals serve only to contribute toward understanding of the claims, but are in no way limitative of the scope of protection. The rights described are defined by the following claims, within the scope of which many modifications can be envisaged.

The invention claimed is:

1. A centrifugal fan, comprising:

a fan housing with a radial outlet opening arranged in a radial peripheral wall thereof; and a rotor arranged rotatably in the fan housing;

wherein the fan housing is provided with an inlet opening, and wherein a sound-reducing tube part extends in the fan housing defining the radial outlet opening of the fan housing arranged in the radial peripheral wall and extending inward along the radial peripheral wall, radially relative to the rotor along and adjacently of the rotor, whereby the radial outlet opening is displaced inward from the radial peripheral wall of the fan housing into the fan housing; and wherein the sound reducing tube part is tapered such that a widening of the sound reducing tube part occurs downstream of the open end of the sound reducing tube part situated in the fan housing.

2. The centrifugal fan as claimed in claim 1, wherein the fan housing comprises a pan-like part, in which the rotor is arranged, and a cover mounted releasably on the pan-like part.

3. The centrifugal fan as claimed in claim 2, wherein the tube part extends in the fan housing from the radial outlet opening arranged in the radial peripheral wall and inward along the radial peripheral wall at a distance relative to the cover.

4. The centrifugal fan as claimed in claim 3, wherein the tube part defines, of itself and without being closed by means of the cover, in the pan-like part of the fan housing a discharge passage closed all around relative to a through-flow direction and having an entrance thereof at a distance from the radial outlet opening.

5. The centrifugal fan as claimed in claim 1, wherein the tube part comprises a curvature corresponding to and at some distance from a periphery of the rotor.

6. The centrifugal fan as claimed in claim 1, wherein the tapering part of the tube part comprises a curved contour which substantially corresponds to the outer periphery of the rotor.

7. The centrifugal fan as claimed in claim 1, wherein the distance between the outer periphery of the rotor and the wall of the tube part facing toward the rotor lies in the range of 1-10 millimeters (mm).

8. The centrifugal fan as claimed in claim 1, wherein the tube part extending in the fan housing comprises a further tube part of constant cross-section between the radial peripheral wall and the tapering part.

9. The centrifugal fan as claimed in claim 8, wherein the tube part extending in the fan housing comprises between the radial peripheral wall and the open end of the tube part at least one passage arranged in a peripheral wall of the tube part.

10. The centrifugal fan as claimed in claim 9, wherein the passage arranged in the peripheral wall of the tube part is arranged in the area between the tapering part and the radial peripheral wall.

11. The centrifugal fan as claimed in claim 9, wherein the passage arranged in the peripheral wall of the tube part is arranged in the further tube part of substantially constant cross-section.

12. The centrifugal fan as claimed in claim 9, wherein the passage arranged in the peripheral wall of the tube part is arranged in the transition between the tapering part and the further tube part of substantially constant cross-section.

13. The centrifugal fan as claimed in claim 11, wherein the passage arranged in the peripheral wall of the tube part is arranged adjacently of the transition between the tapering part and the further tube part of substantially constant cross-section.

14. The centrifugal fan as claimed in claim 1, wherein the inlet opening of the fan housing is axial and provided with a suction conduit for drawing in a fuel/air mixture, wherein the suction conduit extends in radial direction along the fan housing so that an indrawn fuel/air mixture is deflected close to the inlet opening from a radial flow direction to an axial flow direction.

15. The centrifugal fan as claimed in claim 14, wherein the suction conduit comprises a mixing part which is in fluid connection with a fuel feed conduit and which is further in fluid connection with an air supply.

16. The centrifugal fan as claimed in claim 15, wherein the fuel feed conduit is an inner conduit arranged inside the fluid connection to the air supply.

17. The centrifugal fan as claimed in claim 15, wherein the fluid connection to the air supply comprises an open connection to the environment.

18. The centrifugal fan as claimed in claim 15, wherein the mixing part is provided with a venturi.

19. A heating device, comprising:

a burner with a fuel mixture infeed opening; and the centrifugal fan as claimed in claim 1;

wherein a fluid connection is provided between the fuel mixture infeed opening of the burner and the outlet opening of the centrifugal fan.

* * * * *